US009801524B2

(12) United States Patent
Kan et al.

(10) Patent No.: US 9,801,524 B2
(45) Date of Patent: Oct. 31, 2017

(54) DISHWASHER COMPRISING A LIQUID/GEL DETERGENT DOSING UNIT

(71) Applicant: ARCELIK ANONIM SIRKETI, Istanbul (TR)

(72) Inventors: Ugur Kan, Istanbul (TR); Cumhur Ayvazoglu, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 0 days.

(21) Appl. No.: 15/253,561

(22) Filed: Aug. 31, 2016

(65) Prior Publication Data

US 2017/0065148 A1 Mar. 9, 2017

(30) Foreign Application Priority Data

Sep. 3, 2015 (TR) ..... 2015/10937

(51) Int. Cl.
*A47L 15/44* (2006.01)
*A47L 15/42* (2006.01)

(52) U.S. Cl.
CPC ..... *A47L 15/44* (2013.01); *A47L 15/4257* (2013.01); *A47L 15/449* (2013.01); *A47L 15/4418* (2013.01); *A47L 15/4445* (2013.01)

(58) Field of Classification Search
None
See application file for complete search history.

(56) References Cited

U.S. PATENT DOCUMENTS

2004/0217125 A1* 11/2004 Marone ..... A47L 15/4409 222/64

FOREIGN PATENT DOCUMENTS

WO 2008/034691 A1 3/2008

* cited by examiner

*Primary Examiner* — Michael Barr
*Assistant Examiner* — Jason Riggleman
(74) *Attorney, Agent, or Firm* — Kilpatrick Townsend & Stockton LLP

(57) ABSTRACT

The present invention relates to a dishwasher comprising a body; a washing cabin that is disposed on the body and wherein the washing process is performed; a door that almost completely closes the washing cabin and that has a closed position perpendicular to the floor and an open position almost parallel to the place where access to the washing cabin is provided, and a dosing unit that is disposed on the door, wherein the liquid/gel detergent can be filled and that enables the detergent to be transferred to the washing cabin during the washing process.

13 Claims, 6 Drawing Sheets

DISHWASHER COMPRISING A LIQUID/GEL DETERGENT DOSING UNIT

RELATED APPLICATIONS

This application is a U.S. Non-Provisional patent application claiming the priority of Turkish Patent Application No. 2015/10937 filed on Sep. 3, 2015, the entire contents of which are hereby incorporated by reference.

TECHNICAL FIELD

The present invention relates to a dishwasher comprising a liquid/gel detergent dosing unit that can dose the required amount of detergent into the washing cabin.

BACKGROUND OF THE INVENTION

In dishwashers, it is important that the use of detergent should be in the optimum level for cleaning the dishes due to both the life span of the dishware and also for our health and pollution of the environment because of the chemicals contained therein. At the start of each washing cycle, the detergent is filled into the detergent dispenser disposed on the machine by the user. In washing cycles wherein intensively dirty dishes are washed, generally the use of greater amounts of detergent is preferred. Using the detergent in the right amount is among the factors that directly affect the washing performance. Therefore, lately the use of powder or gel/liquid detergents, the amount of which depends on user preference is becoming widespread. However, the amount of detergent being determined by the user cannot always provide the optimum washing performance. Nowadays, the dosing units that automatically determine the amount of detergent and transfer into the washing cabin are used for finding a solution to this problem. The user fills in the detergent on the dosing unit once and the required detergent during washing is provided by the dosing unit. However, since dosing units have the form of a closed box, determining the remaining detergent level by the user becomes hard. When the detergent on the dosing unit gets low or is completely used up, problems such as dirty washing occur.

In the state of the art International Patent Application No. WO2008034691, a household appliance is disclosed, comprising a dosing unit wherein the level of the remaining detergent can be determined.

The aim of the present invention is the realization of a dishwasher that comprises a dosing unit providing ease of use.

The dishwasher realized in order to attain the aim of the present invention, explicated in the first claim and the respective claims thereof, comprises a body; a washing cabin that is disposed on the body and wherein the washing process is performed, and a door that is disposed on the body and that has open and closed positions. A dosing unit that enables liquid/gel detergent dosing to the washing cabin is disposed on the door.

The dishwasher of the present invention comprises a detergent dispenser that is disposed on the dosing unit and wherein the detergent is filled in by the user, and a detergent level measuring means that has more than one cells disposed in the detergent dispenser so as to be positioned side by side when the door is in the open position and one above the other when the door is changed to the closed position. The detergent in the detergent dispenser fills in the cells when the door is in the closed position. When the door changes to the open position, the detergent filled in the cells cannot go back to the detergent dispenser. Thus, when the door is in the open position, information on the remaining detergent in the detergent dispenser can be provided by looking at the number of the filled cells.

The cells are in form of a box with one side open. When the door is in the open position, the open sides of the cells face the ceiling of the detergent dispenser. When the door is changed to the closed position, the open sides of the cells face the interior of the body. When the door is changed to the closed position, the detergent in the detergent dispenser fills in the cells by passing through this open mouth portion of the cells.

In an embodiment of the present invention, the detergent level measuring means is disposed in the detergent dispenser so as to be close to the lower portion of the detergent dispenser when the door is in the closed position. Thus, when the door is in the closed position, the detergent is enabled to fill in the cells even if the amount of the detergent in the detergent dispenser is low.

In an embodiment of the present invention, when the door is in the open position, there is a gap between the upper surfaces of the cells and the ceiling of the detergent dispenser. When the door is changed to the closed position, the detergent in the detergent dispenser passes through the gap to fill in the cells. Again, similarly, when the door is changed to the open position from the closed position, the detergent in the detergent dispenser passes through to gap to disperse inside the detergent dispenser.

When the door is in the open position, the base of the cells is at a higher level than the base of the detergent dispenser. Thus, the volume of the cells is enabled to be reduced. In an embodiment of the present invention, the wall that is arranged on the cell and that is close to the floor when the door is in the closed position is inclined. Thus, when the door is in the closed position, the passing of the detergent from one cell to another that flows from the detergent dispenser towards the cells is facilitated.

In an embodiment of the present invention, the detergent level measuring means is produced from transparent material. Thus, the detergent in the cells can easily be seen by the user.

In an embodiment of the present invention, the dosing unit can be attached/detached by the user. Thus, the detergent residues remaining in the detergent dispenser and the detergent level measuring means can be easily cleaned by the user.

In an embodiment of the present invention, the dosing unit comprises more than one opening that enables the cells to be easily seen by the user. An opening is arranged on each cell.

In an embodiment of the present invention, the dishwasher comprises a sensor that is disposed on the base of each cell and that can detect the presence of the detergent, and a control unit that evaluates the information received from the sensor. By means of the sensor and the control unit, the user is enabled to be warned even in the situations that user has no information on the amount of the detergent.

In an embodiment of the present invention, the dishwasher comprises a control panel that is disposed on the door and that enables the user to select the washing parameters. An illumination element that corresponds to each cell is disposed on the control panel. When the cells get empty, the control unit enables the user to be warned by means of the illumination elements.

In an embodiment of the present invention, a protective cover is disposed on the dosing unit. The protective cover can also be used for decorative purposes. The dosing amounts can be located on the protective cover to inform the user.

In an embodiment of the present invention, the protective cover comprises an indicator. The indicator enables the openings to be seen by the user.

BRIEF DESCRIPTION OF THE DRAWINGS

The dishwasher realized in order to attain the aim of the present invention is illustrated in the attached figures, where.

Figure 1:
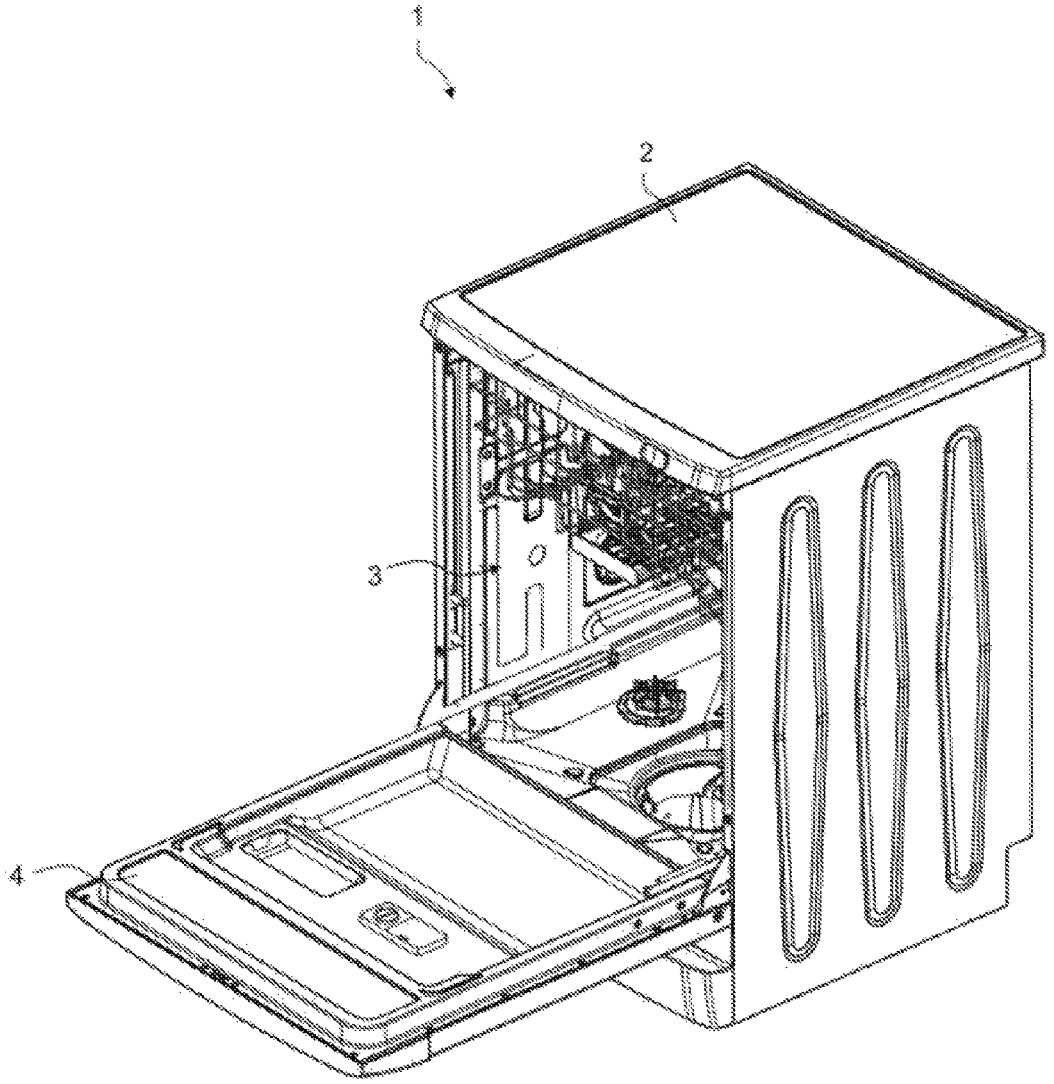
FIG. 1—is the perspective view of the dishwasher when the door is in the open position.
Figure 2:
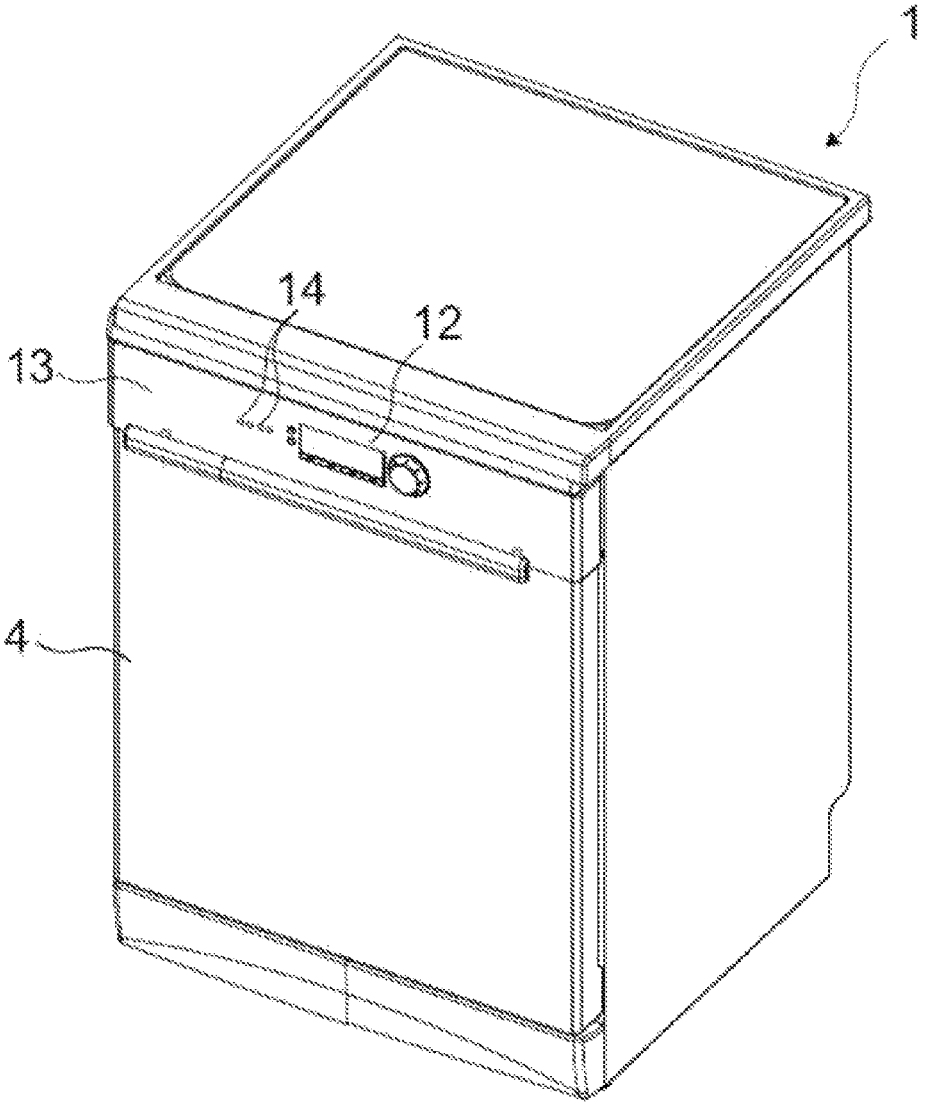
FIG. 2—is the perspective view of the dishwasher when the door is in the closed position.
Figure 3:
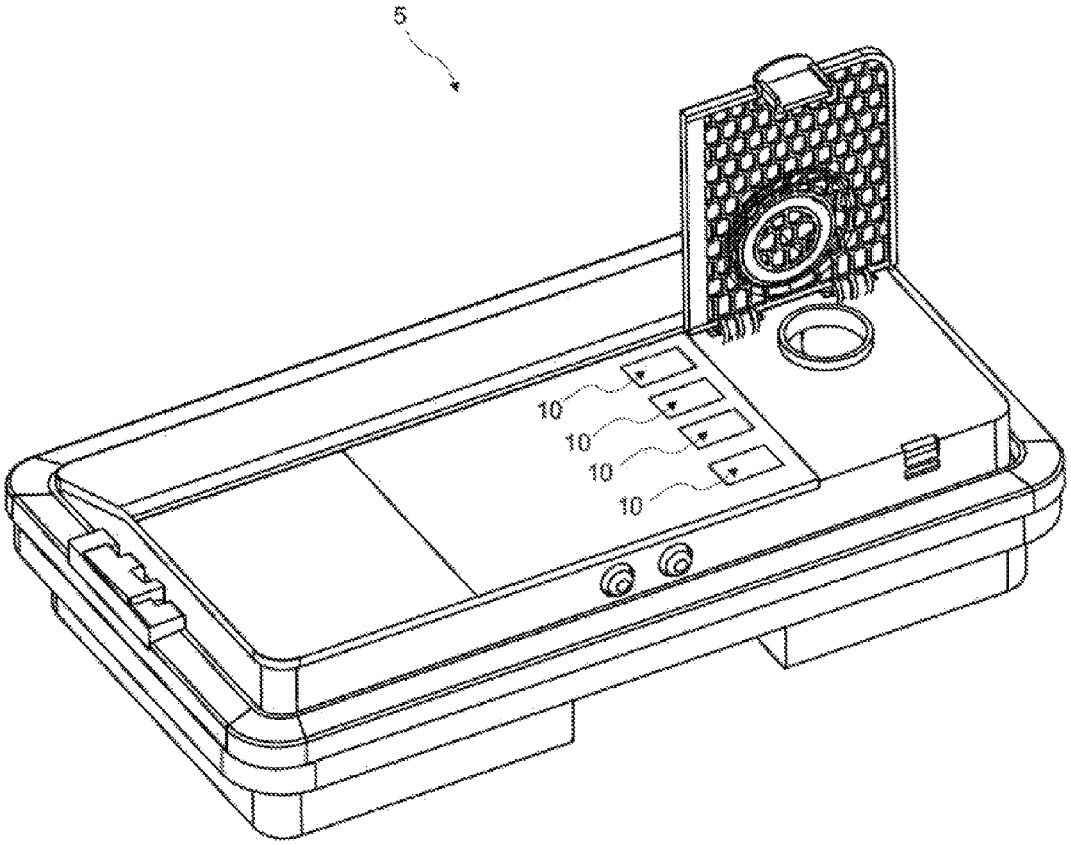
FIG. 3—is the perspective view of the dosing unit.
Figure 4:
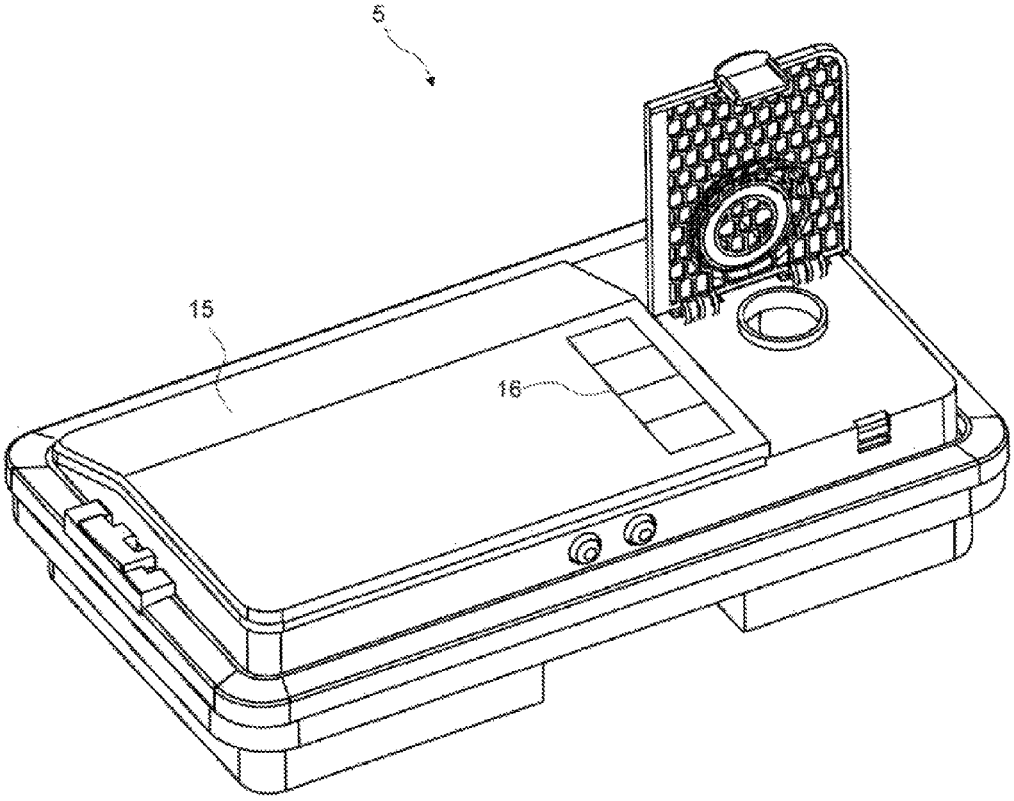
FIG. 4—is the perspective view of the cover on the dosing unit.
Figure 5:
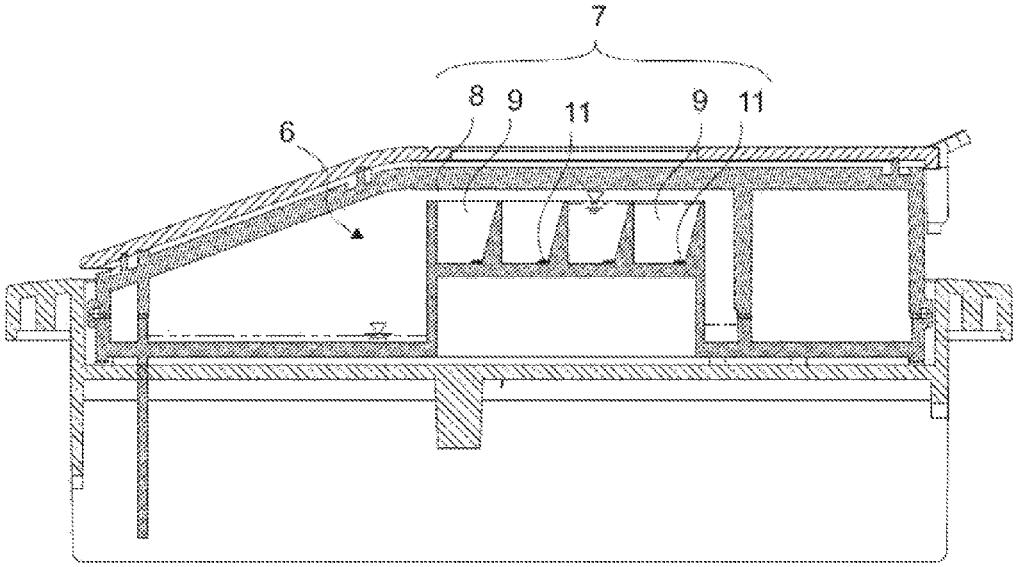
FIG. 5—is the cross-sectional view of the detergent dispenser and the cells when the door is in the open position.
Figure 6:
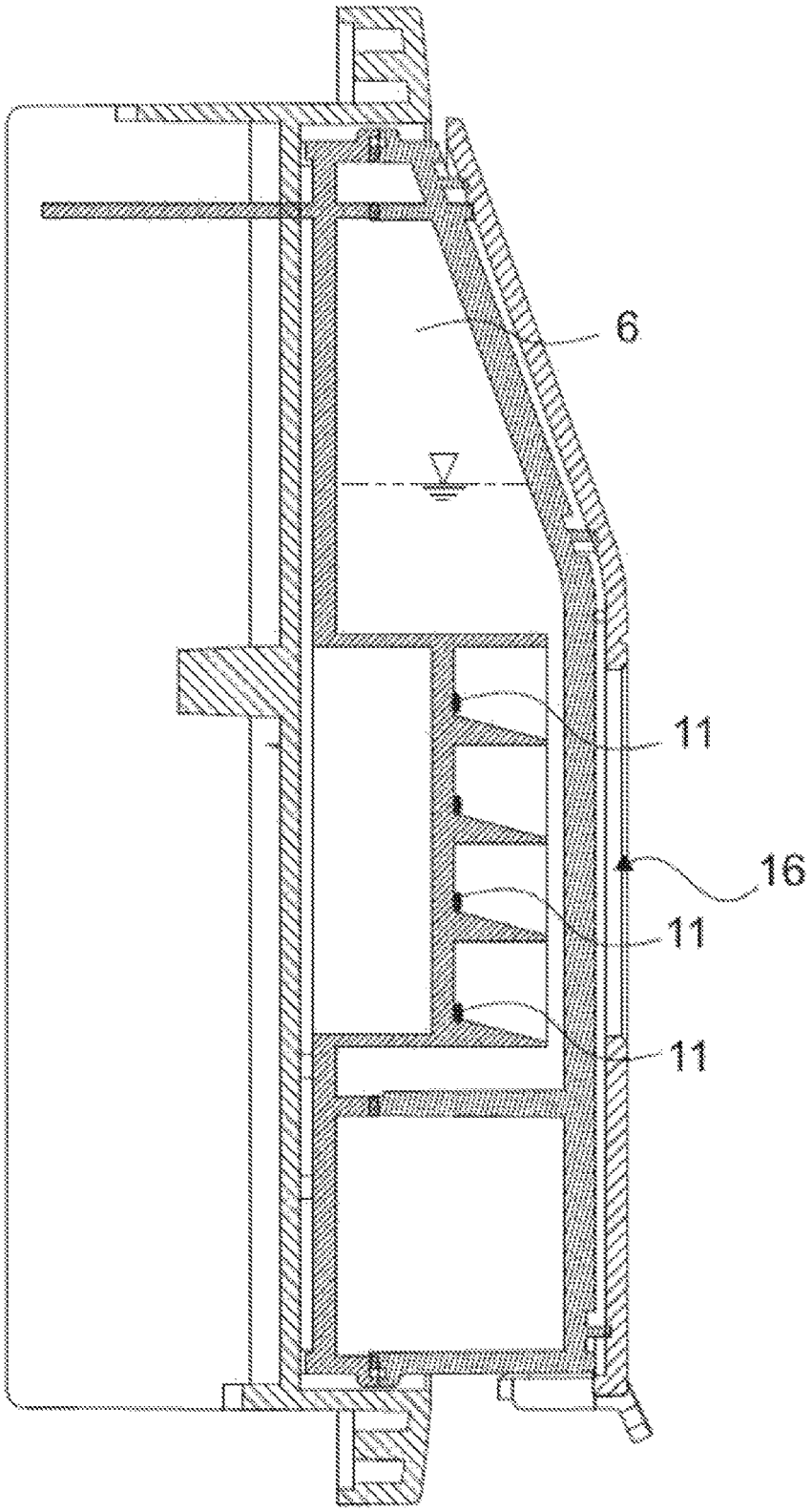
FIG. 6—is the cross-sectional view of the detergent dispenser and the cells when the door is in the closed position.

The elements illustrated in the figures are numbered as follows:

1—Dishwasher
2—Body
3—Washing cabin
4—Door
5—Dosing unit
6—Detergent dispenser
7—Detergent level measuring means
8—Gap
9—Cell
10—Opening
11—Sensor
12—Control unit
13—Control panel
14—Illumination element
15—Protective cover
16—Indicator

DETAILED DESCRIPTION

The dishwasher (1) comprises a body (2); a washing cabin (3) that is disposed on the body (2) and wherein the washing process is performed; a door (4) that almost completely closes the washing cabin (3) and that has a closed position (K) wherein the door (4) extends in a direction perpendicular to the floor and an open position (A) wherein the door (4) extends almost parallel to the place where access to the washing cabin (3) is provided, and a dosing unit (5) that is disposed on the door (4), wherein the liquid/gel detergent can be filled and that enables the detergent to be transferred to the washing cabin (3) during the washing process. By means of the dosing unit (5), the detergent is automatically transferred to the washing cabin (3). The dishwasher (1) of the present invention comprises a detergent dispenser (6) that is disposed on the dosing unit (5) and wherein the detergent is filled in by the user, and a detergent level measuring means (7) that is disposed in the detergent dispenser (6), that has more than one adjacent cell (9) so as to be positioned side by side when the door (4) is in the open position (A) and one above the other when the door (4) is changed to the closed position (K), wherein the detergent filled in the detergent dispenser (6) is filled in the cells (9) when the door (4) is in the closed position (K), and that enables the amount of the detergent to be measured when the door (4) is changed to the open position (A) according to the number of the filled cells (9). When the door (4) is in the closed position (K), some of the detergent in the detergent dispenser (6) flows towards the cells (9) and fills in the cells (9). The cells (9) that are filled with detergent when the door (4) is in the closed position (K) remain filled when the door (4) is changed to the open position (A). The number of cells (9) that are filled in proportion with the amount of detergent in the detergent dispenser (6) informs the user on the amount of detergent remaining in the detergent dispenser (6) when the door (4) is changed to the open position (A).

When the door (4) is in the open position (A), the mouths of the cells (9) face the ceiling of the detergent dispenser (6). Thus, the detergent in the detergent dispenser (6) is enabled to flow downwards with the effect of the gravity and to fill in the cells (9) from the open mouths of the cells (9) when the door (4) is changed to the closed position (K). The number of the filled cells (9) is in direct proportion with the amount of the detergent in the detergent dispenser (6). When the door (4) is changed back to the open position (A) from the closed position (K), the detergent that is filled in the cells (9) remains in the cells (9). Thus, the user is enabled to understand the amount of the detergent in the detergent dispenser (6) according to the number of the filled cells (9).

In an embodiment of the present invention, the detergent level measuring means (7) is disposed in the detergent dispenser (6) so that the lowermost cell (9) is close to the base of the detergent dispenser (6) when the door (4) is in the closed position. Thus, even if the amount of the detergent in the detergent dispenser (6) is low, the detergent in the detergent dispenser (6) is enabled to fill in the cells (9) when the door (4) is changed to the closed position (K). Thus, the reliability of measurement is provided.

In another embodiment of the present invention, the dosing unit (5) comprises a gap (8) that is situated between the upper surfaces of the cells (9) and the ceiling of the detergent dispenser (6) when the door (4) is in the open position (A), and that enables the detergent located in the detergent dispenser (6) to fill in the cells (9) when the door (4) is in the closed position (K). The detergent that is filled in the detergent dispenser (6) by the user when the door (4) is the open position (A) disperses to the interior of the detergent dispenser (6). When the door (4) is changed to the closed position (K) from the open position (A), the detergent in the detergent dispenser (6) flows towards the cells (9) by means of the gap (8). When the door (4) is changed back to the open position (A) from the closed position (K), the detergent that is collected to the lower portion of the detergent dispenser (6) disperses to the interior of the detergent dispenser (6) by means of the gap (8).

In another embodiment of the present invention, there is a level difference between the door (4) and the base of the detergent dispenser (6) when the door (4) is in the open position (A). By means of the base of the cells (9) being higher than the base of the detergent dispenser (6) when the door (4) is in the open position (A), the volume of the cells (9) is enabled to be reduced. Thus, the amount of the detergent that fills in the cells (9) is enabled to be reduced when the door (4) is changed to the closed position (K). Moreover, by means of the base of the cells (9) being higher than the base of the detergent dispenser (6) when the door (4) is in the open position (A), the cells (9) are enabled to come close to the ceiling of the detergent dispenser (6), and the detergent that is filled in the cells (9) are enabled to be easily seen by the user.

In an embodiment of the present invention, the detergent level measuring means (7) comprises cells (9) of which the wall that is close to the floor is inclined when in the closed position. When the door (4) is on the closed position (K), the cells (9) are position one under the other so that detergent dispenser (6) is at the uppermost position. The detergent flows to the cells (9) from the detergent dispenser (6) by means of the gap (8). By means of the wall arranged on the cell (9) is close to the floor being inclined, the flow of the detergent from one cell (9) to the other can easily be realized.

In an embodiment of the present invention, the detergent level measuring means (7) is produced from transparent material. The transparent material enables the user to easily detect the detergent that is on the detergent level measuring means (7). Thus, the amount of the detergent remaining in the detergent dispenser (6) can easily be determined.

In an embodiment of the present invention, the dosing unit (5) can be attached/detached by the user. The detergent level measuring means (7) and the detergent dispenser (6) can be easily detached and washed by the user. Thus, the detergent residues forming in the detergent dispenser (6) and the detergent level measuring means (7) can be cleaned.

In an embodiment of the present invention, the dosing unit (5) comprises one or more than one opening (10), each facing one cell (9). Thus, the user can see the amount of the detergent remaining in the detergent dispenser (6) through the dosing unit (5).

In an embodiment of the present invention, the dishwasher (1) comprises a sensor (11) that is disposed at the base of each cell (9) and that detects the presence of the detergent, and a control unit (12) that enables the user to be warned with the information received from the sensor (11). Thus, the user is warned by means of the control unit (12) when the detergent is used up even if the user does not pay attention to the openings (10) on the dosing unit (5).

In an embodiment of the present invention, the dishwasher (1) comprises a control panel (13) that is disposed on the door (4) and that enables the user to define the washing parameters; an illumination element (14) that is disposed on the control panel (13) and that corresponds to each cell (9), and the control unit (12) that enables the user to be warned by means of the illumination element (14) when each cell (9) gets empty. The emptying of the cells (9) is detected by the control unit (12) by means of the sensor (11), and the user is warned by the illumination element (14) corresponding to the relevant cell (9). Thus, the user can see the amount of the detergent remaining in the detergent dispenser (6) without changing the door (4) to the open position (A).

In an embodiment of the present invention, the dosing unit (5) comprises a protective cover (15). The protective cover (15) can be also used for a decorative purpose. The dosing amounts corresponding to the washing programs are disposed on the protective cover (15) to inform the user.

In an embodiment of the present invention, the dosing unit (5) comprises an indicator (16) that is disposed on the protective cover (15) and that enables the openings (10) to be seen by the user. By means of the indicator (16), openings (10) on the dosing unit (5) are enabled to be seen.

By means of the present invention, a dishwasher (1) is realized, comprising a liquid/gel detergent dosing unit (5) having a detergent level measuring means (7). Thus, the user can see the amount of the detergent remaining in the dosing unit (5) and can add more detergent before the detergent is completely used up. The amount of detergent required in each washing is enabled to be in the dosing unit (5).

What is claimed is:

1. A dishwasher comprising a body; a washing cabin that is disposed on the body and wherein the washing process is performed; a door that almost completely closes the washing cabin and that has a closed position wherein the door extends in a direction perpendicular to the floor and an open position wherein the door extends almost parallel to the place where access to the washing cabin is provided, and a dosing unit that is disposed on the door, wherein the liquid/gel detergent can be filled and that enables the detergent to be transferred to the washing cabin during the washing process, a detergent dispenser that is disposed on the dosing unit and wherein the detergent is filled in by the user, and a detergent level measuring means that is disposed in the detergent dispenser, that has more than one adjacent cell so as to be positioned side by side when the door is in the open position and one above the other when the door is changed to the closed position, wherein the detergent filled in the detergent dispenser is filled in the cells when the door is in the closed position, and that enables the amount of the detergent to be measured when the door is changed to the open position according to the number of the filled cells.

2. A dishwasher as in claim 1, wherein the cells of which the mouths face the ceiling of the detergent dispenser when the door is in the open position.

3. A dishwasher as in claim 1, wherein the detergent level measuring means is disposed in the detergent dispenser so that the lowermost cell is close to the base of the detergent dispenser when the door is in the closed position.

4. A dishwasher as in claim 1, wherein the dosing unit comprises a gap that is situated between the upper surfaces of the cells and the ceiling of the detergent dispenser when the door is in the open position, and enables the detergent located in the detergent dispenser to fill in the cells when the door is in the closed position.

5. A dishwasher as in claim 1, wherein the cells have a level difference with respect to the base of the detergent dispenser when the door is in the open position.

6. A dishwasher as in claim 1, wherein the cells of which the wall that is close to the floor is inclined when the door is in the closed position.

7. A dishwasher as in claim 1, wherein the detergent level measuring means is produced from transparent material.

8. A dishwasher as in claim 1, wherein the dosing unit is attached/detached by the user.

9. A dishwasher as in claim 1, wherein more than one opening are disposed on the dosing unit, each corresponding one cell.

10. A dishwasher as in claim 1, wherein a sensor is disposed at the base of each cell and detects the presence of the detergent; and a control unit enables the user to be warned with the information received from the sensor.

11. A dishwasher as in claim 10, wherein a control panel is disposed on the door and enables the user to define the washing parameters; an illumination element is disposed on the control panel and that corresponds to each cell, and the control unit enables the user to be warned by means of the illumination element when each cell gets empty.

12. A dishwasher as in claim 1, wherein a protective cover is disposed on the dosing unit.

13. A dishwasher as in claim 12, wherein the dosing unit comprises an indicator that is disposed on the protective cover and enables openings disposed on the dosing unit to be seen by the user.

* * * * *